US010051965B2

(12) United States Patent
Hoffman-Hewitt

(10) Patent No.: US 10,051,965 B2
(45) Date of Patent: Aug. 21, 2018

(54) MODIFIED FOOTREST FOR SALON CHAIR

(71) Applicant: Hewitt Design Group, LLC, Gilmanton, NH (US)

(72) Inventor: Amy W. Hoffman-Hewitt, Gilmanton, NH (US)

(73) Assignee: Hewitt Design Group, LLC, Gilmanton, NH (US)

( * ) Notice: Subject to any disclaimer, the term of this patent is extended or adjusted under 35 U.S.C. 154(b) by 203 days.

(21) Appl. No.: 15/059,431

(22) Filed: Mar. 3, 2016

(65) Prior Publication Data

US 2016/0286960 A1 Oct. 6, 2016

Related U.S. Application Data

(60) Provisional application No. 62/142,679, filed on Apr. 3, 2015.

(51) Int. Cl.

| | |
|---|---|
| ***A47C 1/06*** | (2006.01) |
| ***A47C 7/50*** | (2006.01) |
| ***A47C 7/00*** | (2006.01) |

(52) U.S. Cl.

CPC ..... *A47C 1/06* (2013.01); *A47C 7/004* (2013.01); *A47C 7/503* (2013.01); *A47C 7/506* (2013.01)

(58) Field of Classification Search

CPC ..... A47C 1/06; A47C 7/503; A47C 7/506; A47C 1/04; A47C 7/004; A47C 7/52; A47C 1/11; A74C 7/503; A74C 7/506; A74C 1/06; A74C 1/04

See application file for complete search history.

(56) References Cited

U.S. PATENT DOCUMENTS

| | | | | |
|---|---|---|---|---|
| 3,453,027 | A | 7/1969 | Pivacek | |
| 3,891,270 | A * | 6/1975 | Crossman | A47C 3/30 248/404 |
| 4,463,985 | A * | 8/1984 | Kynast | A61G 5/12 297/423.1 |
| 4,981,305 | A * | 1/1991 | Lockard | A61G 5/00 280/250.1 |
| 4,988,114 | A * | 1/1991 | Thornton, Jr. | A61G 5/12 280/304.1 |
| 5,039,167 | A | 8/1991 | Sweet | |
| 5,494,334 | A | 2/1996 | Zvonik | |
| 5,522,644 | A * | 6/1996 | Peek | A47C 7/503 297/423.26 |
| 6,338,493 | B1 * | 1/2002 | Wohlgemuth | A61G 5/00 135/66 |
| 6,499,756 | B2 * | 12/2002 | Amirola | A61G 5/12 280/250.1 |

(Continued)

*Primary Examiner* — David R Dunn
*Assistant Examiner* — Tania Abraham
(74) *Attorney, Agent, or Firm* — Davis & Bujold, P.L.L.C.; Kimberly A. Peaslee

(57) ABSTRACT

Modified footrest assembly for a salon chair having an upper and a lower portion configured to latch into a first position and pivot about a point. Modified footrest assembly having a length such that it is configured to support a person's foot in a first position and not protrude beyond a chair when in a second position. Modified, modular footrest assembly configured to mount and unmount from a variety of chairs. Modified, modular footrest assembly having a left and a right side and configured so that each side operates independently.

15 Claims, 9 Drawing Sheets

(56) References Cited

U.S. PATENT DOCUMENTS

| | | | | |
|---|---|---|---|---|
| 6,533,360 | B1 * | 3/2003 | Parkel | A47C 7/506 297/423.28 |
| 6,733,081 | B1 * | 5/2004 | Follon | A47C 1/04 297/423.26 |
| 7,445,586 | B2 * | 11/2008 | Gibson | A47C 7/503 482/142 |
| 7,549,703 | B2 * | 6/2009 | McElhinney | A47C 3/30 280/304.1 |
| 7,635,142 | B2 * | 12/2009 | Slagerman | A61G 5/12 280/291 |
| 7,963,610 | B2 | 6/2011 | Barfuss | |
| 8,052,217 | B2 * | 11/2011 | Toso | A47C 7/46 297/423.11 |
| 8,205,936 | B2 * | 6/2012 | Alessandro | A47C 1/026 297/118 |
| 8,246,118 | B2 * | 8/2012 | Moore | A47C 7/52 297/423.1 |
| 8,573,610 | B1 * | 11/2013 | Meyers | A61G 5/128 280/47.4 |
| 2004/0051279 | A1 * | 3/2004 | Grant | A61G 5/1059 280/638 |
| 2010/0301574 | A1 * | 12/2010 | Derks | A61G 5/08 280/47.4 |
| 2011/0133527 | A1 | 6/2011 | Taylor | |
| 2014/0132041 | A1 * | 5/2014 | Manus | A47C 4/44 297/119 |
| 2014/0167456 | A1 * | 6/2014 | Andoloro | A47C 1/026 297/115 |

* cited by examiner

Page 1 of 8

8
11A
11B
10

8
15
13
12
17
19
21

8
14
12
14
17
19
8
14

8
20
18
15
21
13
12
17
A

Page 2 of 8

8
11B
11A
14b
20
14a
18
15
13
12
17
19
21

8
18
15
13
12
17
19
21

Page 5 of 8

MODIFIED FOOTREST FOR SALON CHAIR

CROSS REFERENCE TO RELATED APPLICATIONS

This Application claims the benefit of U.S. Provisional Application No. 62/142,679, filed Apr. 3, 2015, the contents of which are incorporated by reference herein in their entirety.

FIELD OF THE INVENTION

The present disclosure relates to footrests for salon chairs and more particularly to modified footrests for salon chairs that allow access to the chair by individuals who do or do not have mobility challenges.

BACKGROUND OF THE INVENTION

Salon chairs are widely used by stylists, barbers, estheticians, and the like to perform a variety of services for an individual while they are seated in the chair. Conventional salon chairs have a seat, back rest, arms, and some form of footrest to help the individual in the chair remain comfortable as the chair is raised and/or lowered to accommodate the person providing services such as cutting, coloring, styling hair, and the like.

Chairs that have a fixed footrest present an obstacle and a danger to individuals including the stylist and the customer. This is especially true for individuals with limited mobility. The present application provides a modular footrest for salon chairs that allows individuals with or without mobility challenges to navigate around, the salon chair without injury. Once seated, the footrests can be moved into position in front of the user. Once the services are complete the footrests can be moved underneath the chair so that no obstruction is present.

SUMMARY OF THE INVENTION

It has been recognized that salon chairs are difficult and dangerous to get into for individuals with limited mobility. It has also been recognized that current footrests on salon chairs are an obstacle and a danger to individuals seeking salon services and to individuals providing salon services.

One aspect of the present disclosure is a modified footrest assembly for a salon chair comprising, an upper portion, comprising an attachment plate to removably attach the footrest assembly to a chair; a tube; one or more upper mounting brackets attached to the tube; and one or more hinge pins accompanying the upper mounting brackets; and a lower portion, comprising a leg support having a length wherein the leg support is configured to support a person's foot in a first position and wherein the leg support is configured to not protrude beyond a chair when in a second position, one or more lower mounting brackets attached to the leg support, and a latch attached one or more of the lower mounting brackets, thereby forming a modified footrest for a salon chair that is configured to pivot on the one or more hinge pins of the upper portion and wherein the latch further comprises a spring configured to influence the motion of the lower portion of the footrest relative to the upper portion of the footrest when the latch is opened.

One embodiment of the modified footrest assembly for a salon chair is wherein the leg support has a round cross section.

One embodiment of the modified footrest assembly for a salon chair is wherein the leg support is hollow.

One embodiment of the modified footrest assembly for a salon chair is wherein the leg support is chrome plated.

One embodiment of the modified footrest assembly for a salon chair is wherein the lower portion of the footrest assembly comprises an upper leg support and a lower leg support.

Another aspect of the present disclosure is a salon chair comprising, a back; a seat having a width, a depth, a top surface and a bottom surface; a pedestal having a base; a footrest assembly comprising; an upper portion, comprising an attachment plate to removably attach the footrest assembly to a chair; a tube; one or more upper mounting brackets attached to the tube; and one or more hinge pins accompanying the upper mounting brackets; and a lower portion, comprising a leg support having a length wherein the leg support is configured to support a person's foot in a first position and wherein the leg support is configured to not protrude beyond the chair when in a second position; one or more lower mounting, brackets attached to the leg support; and a latch attached to one or more of the lower mounting brackets, thereby forming a modified footrest for a salon chair that is configured to pivot from a first position to a second potion about the one or more hinge pins and wherein the latch further comprises a spring configured to influence the motion of the lower portion of the footrest relative to the upper portion of the footrest when the latch is opened.

One embodiment of the salon chair is wherein the modified footrest assembly has a leg support that has a round cross section.

One embodiment of the salon chair is wherein the modified footrest assembly has a leg support that is hollow.

One embodiment of the salon chair is wherein the modified footrest assembly has a leg support that is chrome plated.

One embodiment of the salon chair is wherein the lower portion of the footrest assembly comprises an upper leg support and a lower leg support.

Another aspect of the present disclosure is a lower portion of a footrest assembly, comprising a leg support having a length wherein the leg support is configured to support a person's foot in a first position and wherein the leg support is configured to not protrude beyond the chair when in a second position; one or more lower mounting brackets attached to the leg support; and a latch attached to one or more of the lower mounting brackets, thereby forming, a modified footrest for a salon chair that is configured to pivot from a first position to a second potion about the one or more binge pins and wherein the latch further comprises a spring configured to influence the motion of the lower portion of the footrest relative to an upper portion of the footrest when the latch is opened.

One embodiment of the lower portion of a footrest assembly is wherein the leg support has a round cross section.

One embodiment of the lower portion of a footrest assembly is wherein the leg support is hollow.

One embodiment of the lower portion of a footrest assembly is wherein the leg support is chrome plated.

One embodiment of the lower portion of a footrest assembly further comprises an upper lea support and a lower leg support.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE INVENTION

Figure 1:
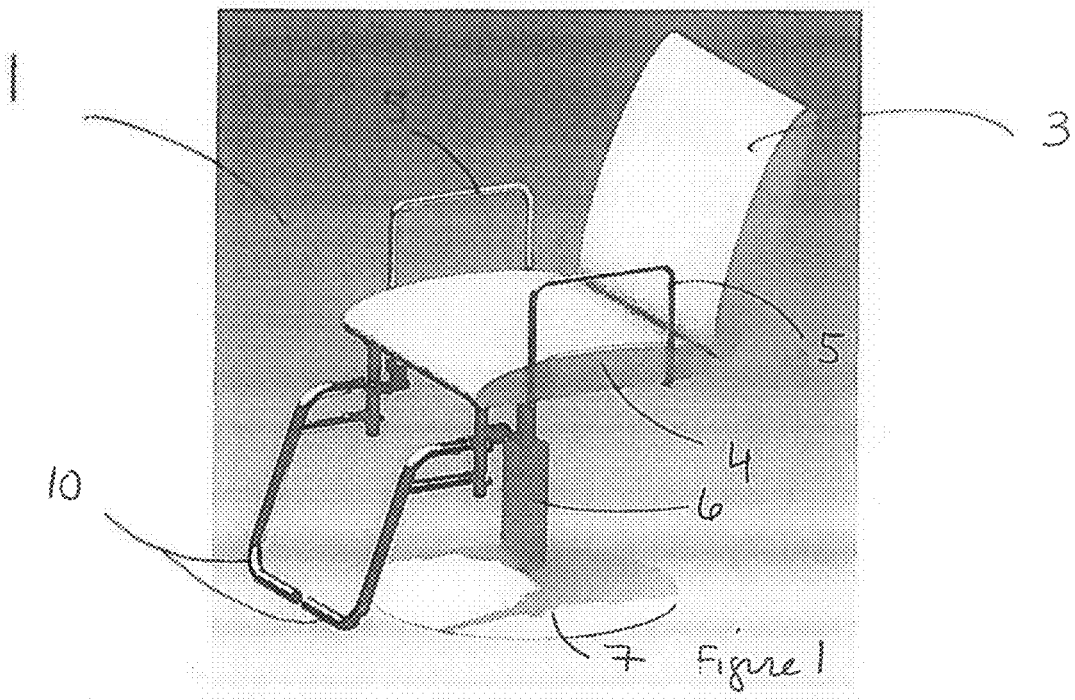
FIG. 1 shows one embodiment of the modified footrest of the present disclosure on a chair and in a first position.

In certain embodiments of the modified footrest of the present disclosure, the footrest is modular. In certain embodiments, the footrests are configured to fit a variety of styling chairs. In certain embodiments, the pair of modified footrests operates independently of each other to provide greater flexibility.

It has been recognized that salon chairs are difficult and dangerous to get into for individuals with limited mobility. It has also been recognized that current footrests on salon chairs are an obstacle and a danger to individuals seeking salon services and to individuals providing salon services.

Currently, salon chairs have footrests of two basic types. The first type has a single connection point near the front of the chair and resembles a "T" that protrudes from the front of the salon chair at some angle such that a user sitting in the chair can rest their feet. The second type has two connection points, where each connection point is of to either side of the center of the front of the chair. As with the first type, the footrest protrudes from the front of the salon chair at some angle such that a user sitting in the chair can rest their feet.

In some versions of the second type of footrest, the footrest still resembles a "T" but the protruding portion contains two "central" bars. In other versions of the second type, the footrest resembles a "U" where the tops of the "U" connect to the front of the chair, and the bottom of the "U" is a bar or plate where a user rests their feet when sitting in the chair. In another version of the second type, the footrest resembles a "U" that has been cut in half, similar to a wheelchair footrest were the user rests their feet on pedals.

By having a footrest stick out in front of the chair, individuals are at significant risk of bumping into and/or getting caught up in the footrest, if an individual has difficulty seeing the footrest, has mobility issues, and/or is simply not paying attention they can be injured by bumping into the footrest. An individual can also trip and fall, as a result of the protruding footrest, which can cause significant injury to anyone, but even more serious injuries are expected for elderly and/or infirmed individuals.

Of the first type of footrest, there have been modified footrests proposed to help prevent the injury to users of salon chairs and stylists. For example, U.S. Pat. Pub. 2011/0133527 discloses a T-shaped footrest that swivels from left to right. However, this footrest still creates a protrusion on the side of the chair when swiveled to one side that can injure a user as they approach the chair or as they leave the chair. It simply moves the protrusion to one side. The protrusion still creates an obstacle to the stylist who is navigating around the chair, while assisting a customer into or out of the chair and/or while cleaning around the chair after a service has been completed. Similarly, U.S. Pat. No. 5,039,167 discloses a modified T-shaped footrest, it provides for the front most portion of the footrest to tip down to minimize the extent of the protrusion. It also provides for some swiveling from side to side, but as in U.S. Pat. Pub. 2011/0133527 the footrest still protrudes out from the front or side of the chair.

Of the second type of footrest, there have been modified footrests proposed to help prevent the injury to users of salon chairs and to stylists. For example, U.S. Pat. No. 7,963,610 discloses a U-shaped footrest that ratchets back under the chair or pivots under the chair by using a long rod-type handle. The long handle then moves the protrusion from the user's leg area to their thigh or waist area. This still creates a potential for injury for the user as they get into or out of the chair. This is especially true far those with mobility and/or vision issues.

Another current proposed modification to the second type of footrest is found in U.S. Pat. No. 5,494,334. There, the foot rest resembles a wheelchair footrest with a stationary footrest and movable foot pads. This creates not only a protrusion that the user and/or stylist must avoid, but necessitates that the stylist or users flip up/down the footpads. There are similar versions of wheelchair-like footpads that swivel out and away from the front of the chair, but this does not remove the protrusion and also necessitates that the stylist or user swing the footpads into and out of position. This form of modification has a number of problems. First, it resembles a wheelchair and is therefore not something a high-end salon would prefer to have on all of their salon chairs. The wheelchair-like footrests also look "handicap accessible," which further marginalizes users with health conditions. These footrests also make a user feel disabled because they require help as they get into or out of the chair or feel awkward while trying to get the footpads into or out of position. They also remain a hazard for anyone, especially those with vision and/or mobility issues.

There are other wheelchair footrests, such as in U.S. Pat. No. 3,453,027, which would have the same issues with looking like a wheelchair, or handicapped-accessible footrest with large footpads. While the footrests may move out of the "working position" they would have limited use for a salon chair that cannot be moved into position for patient thus avoiding the side protrusion issue.

In certain embodiments of the modified footrest of the present disclosure, the footrest removes the obstacle for a stylist when servicing a customer or when cleaning up after a service has been provided. In certain embodiments of the modified footrest of the present disclosure, the footrest removes the obstacle for an individual who seeks services. In certain embodiments, the modified footrest of the present disclosure allows for access for handicapped individuals. In certain embodiments, the modified footrest does not appear to be handicapped accessible and thus fits with modern salons and with a variety of chair styles. In certain embodiments, individuals are treated with dignity because they can help themselves into the seat and they do not need additional assistance. The amount of fear that individuals have of going into a salon for service cannot be underestimated. There are many instances where stylists are unable to assist customers into position and the risk of injury is too great. In such cases, individuals must forgo services. Certain embodiments of the present disclosure allow individuals to receive services with dignity.

In certain embodiments of the modified footrest of the present disclosure, time savings for stylists are provided while reducing injuries to stylists that do not have to assist customers into or out of the chairs. In certain embodiments, the modified footrest slides out of view and is contained within the profile of the chair—no protrusions. This provides for a clean look, an injury free area, and ease of use and cleaning.

In certain embodiments, the upper portion of the footrest assembly is separate from the lower portion of the footrest assembly. In certain embodiments, the upper portion is adaptable to fit a variety of different salon chairs. In certain embodiments the upper portion is adaptable to a single type of salon chair. In certain embodiments, the lower portion is adaptable to a variety of customers (e.g., short, tall, etc.). In certain embodiments, the lower potion is available in a variety of styles depending on the application. In certain embodiments, the upper portion and the lower portion of the footrest assembly are sold separately and can be mixed and matched, or replaced separately.

Referring to FIG. 1, one embodiment of the modified footrest of the present disclosure on a chair and in a first position is shown. More particularly, a salon chair is shown with a back 3, a seat 4, and arms 5. The salon chair is also shown on a pedestal 6 having a base 7. The salon chair is shown with a pair of footrest assemblies 10 in the first 1, or closed, position. This is the position that an individual would use when resting their feet while sitting in the chair.

Figure 2:
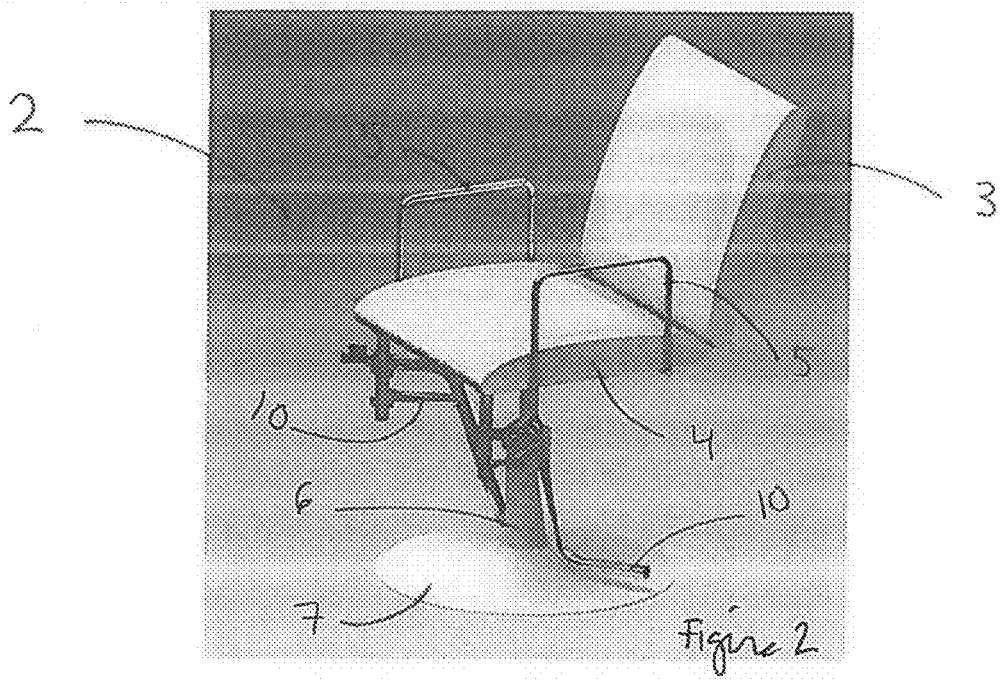
FIG. 2 shows one embodiment of the modified footrest of the present disclosure on a chair and in a second position.

Referring to FIG. 2, one embodiment of the modified footrest of the present disclosure on a chair and in a second position is shown. More particularly, a salon chair is shown with a back 3, a seat 4, and arms 5. The salon chair is also shown on a pedestal 6 having a base 7. The salon chair is shown with a pair of footrest assemblies 10 in the second 2, or open, position. This is the position that an individual or stylist would use when approaching the chair to sit down or get up. This is also the position that a stylist would use when the chair is not in use.

Figures 3, 4A, 4B, 5, 6:
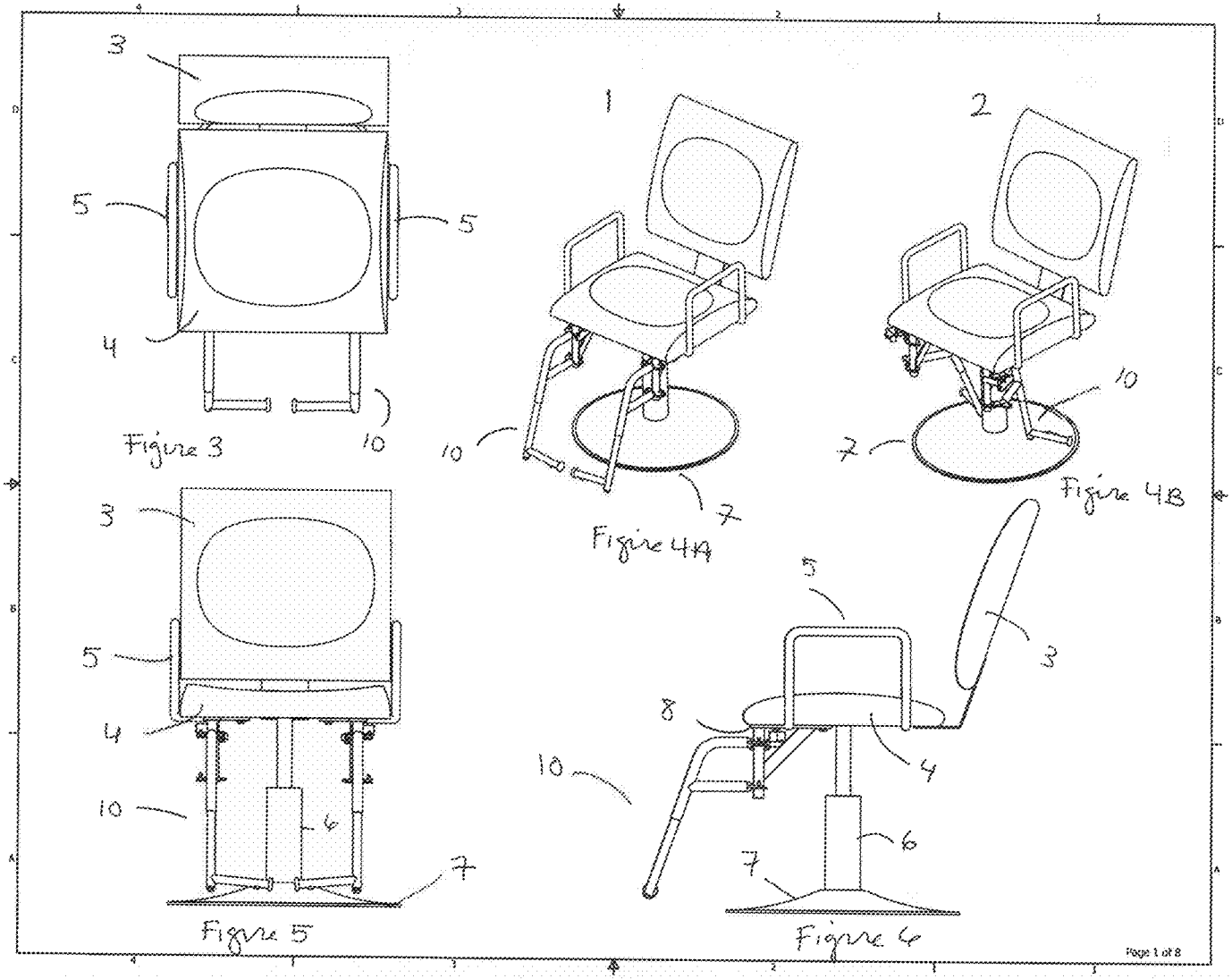
FIG. 3 shows a top view of one embodiment of the modified footrest of the present disclosure on a chair and in a first position.
FIG. 4A shows a perspective view of one embodiment of the modified footrest of the present disclosure on a chair and in a first position.
FIG. 4B shows a perspective view of one embodiment of the modified footrest of the present disclosure on a chair and in a second position.
FIG. 5 shows a front view of one embodiment of the modified footrest of the present disclosure on a chair and in a first position.
FIG. 6 shows a side view of one embodiment of the modified footrest of the present disclosure on a chair and in a first position.

Referring to FIG. 3, a top view of one embodiment of the modified footrest of the present disclosure on a chair and in a first position is shown. More particularly, it is possible to see that for an individual to sit comfortably with their feet resting on the footrest assemblies 10 the footrests tend to extend out further than the pedestal base. The footrests in the first position 1, or closed position, create a considerable obstacle to those who are walking past and/or are approaching the chair to sit down.

Referring to FIG. 4A, a perspective view of one embodiment of the modified footrest of the present disclosure on a chair and in a first position is shown. Referring to FIG. 4B, a perspective view of one embodiment of the modified footrest of the present disclosure on a chair and in a second position is shown. More particularly, it is possible to see that when the footrest assemblies 10 are in the second 2, or open position, the footrests are within the profile of the chair such that the footrests to not protrude out past the chair and thus do not create an obstacle to people walking by and/or approaching the chair. The footrests are positioned on either side of center such that when the footrests are in the second 2, or open position the footrests are positioned alongside the pedestal 6 of the chair. In certain embodiments, the footrests in position 2 do not extend out further than the pedestal base 7.

Referring to FIG. 5, a front view of one embodiment of the modified footrest of the present disclosure on a chair and in a first position is shown. More particularly, the footrest assemblies 10 are shown attached to the underside of the chair seat 4.

Referring to FIG. 6, a side view of one embodiment of the modified footrest of the present disclosure on a chair and in a first position is shown. More particularly, the footrest assemblies 10 are shown attached to the underside of the chair seat 4. The footrests are positioned on the front of the chair to provide support for the user when in the first 1, or closed, position. The footrest assemblies 10 are attached to the underside of the seat 4 using an attachment plate 8.

In certain embodiments of the present disclosure, the footrest assembly is constructed from materials including, but not limited to, metal, plastic, wood, and the like. In certain embodiments, the footrest assemblies have, a cross section that is round, flat, angled, or the like. In certain embodiments, the footrest assemblies are solid. In certain embodiments, the footrest assemblies are hollow. In certain embodiments, the footrest assembly is constructed from about ⅞" tubing. In certain embodiments, the footrest assembly is constructed from about 1" tubing. In certain embodiments, the footrest assembly is constructed from tubing ranging from about ¾" to about 1¾" in diameter. In certain embodiments, the attachment plate is constructed of steel. In certain embodiments, the footrest assembly comprises one or more spring cam lock levers.

Figure 7:
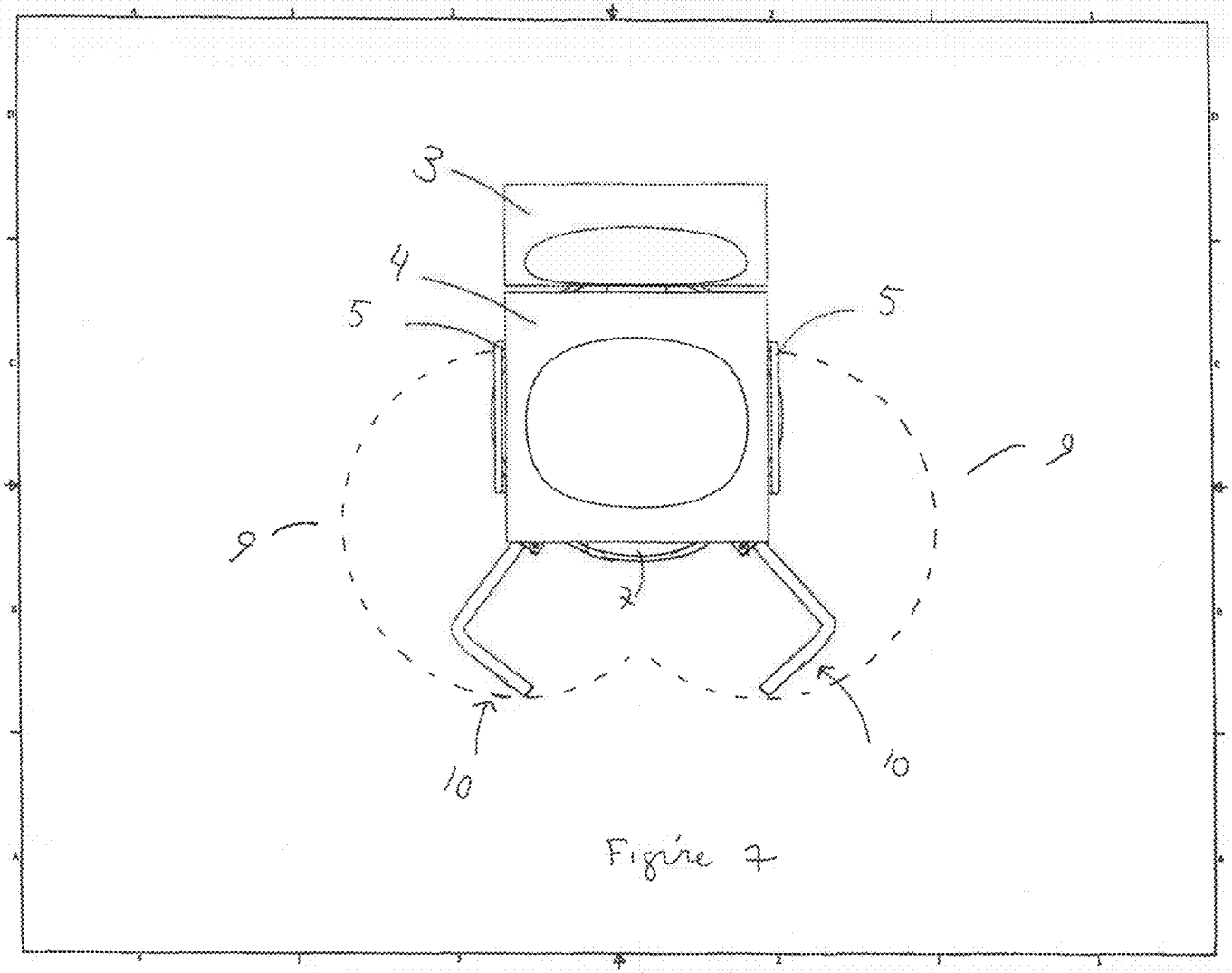
FIG. 7 shows a top view of one embodiment of the modified footrest of the present disclosure on a chair and transitioning from a first position to a second position.

Referring to FIG. 7, a top view of one embodiment of the modified footrest of the present disclosure on a chair is shown as moving between a first position and a second position. More particularly, arcs 9 are shown as dotted lines to depict the motion of the footrest assemblies 10 from a first 1 position to a second 2 position. This is a representation of the movement and is not to scale, but instead is used to demonstrate that each of the footrest assemblies 10 moves around a pivot point. In certain embodiments, the left and right footrests move independently of each other.

Figures 8A, 8B, 8C, 8D:
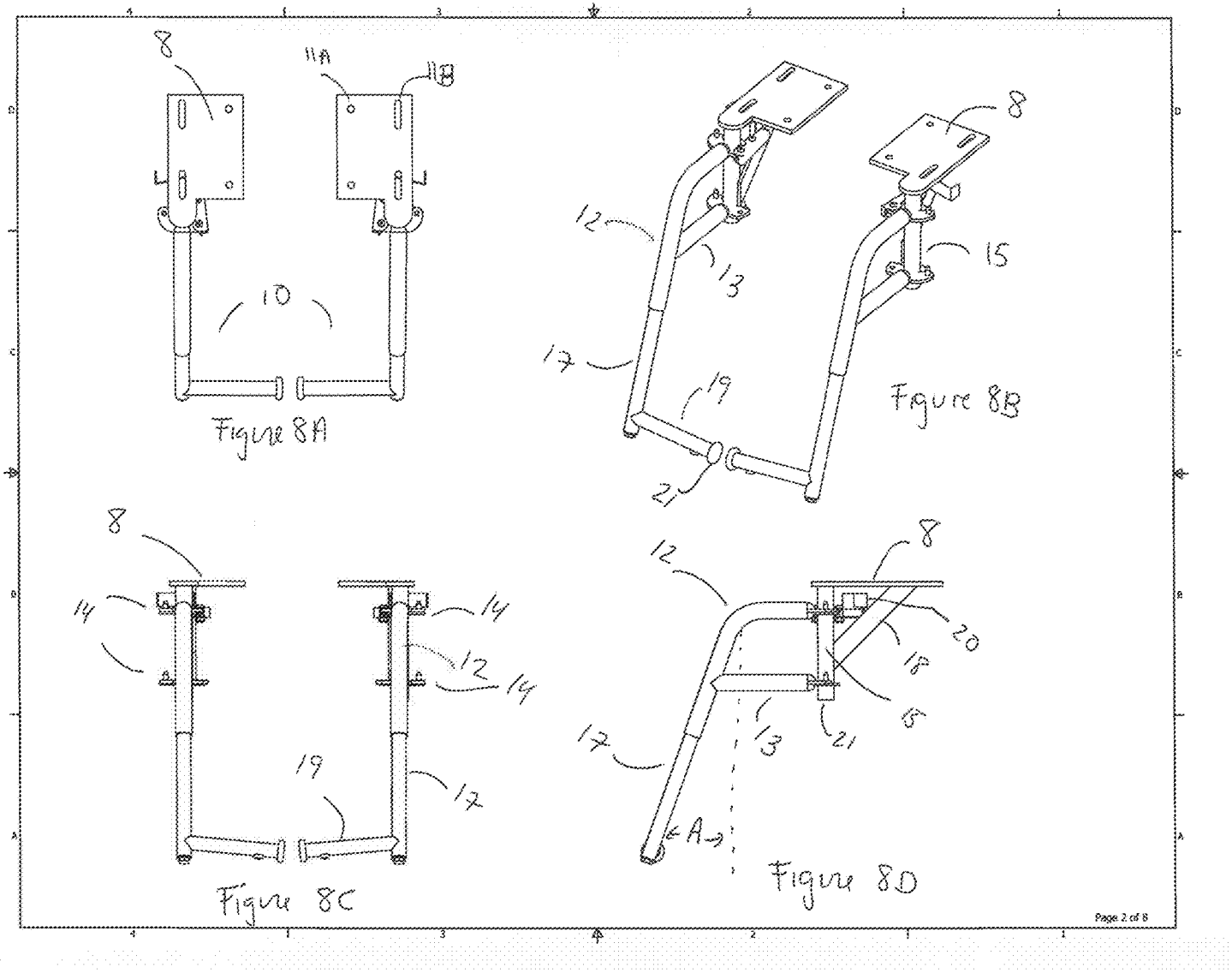
FIG. 8A shows a top view of one embodiment of the modified footrest of the present disclosure in a first position.
FIG. 8B shows a perspective view of one embodiment of the modified footrest of the present disclosure in a first position.
FIG. 8C shows a front view of one embodiment of the modified footrest of the present disclosure in a first position.
FIG. 8D shows a side view of one embodiment of the modified footrest of the present disclosure in a first position.

Referring, to FIG. 8A, a top view of one embodiment of the modified footrest of the present disclosure in a first position is shown. More particularly, the footrest assemblies 10 are shown detached from a chair. An attachment plate 8 is shown with one or more holes 11A and 11B in the plate for attachment to the underside of the chair seat 4 (not shown). In certain embodiments, the number of holes 11A and 11B in the plate may vary depending on the model of chair, so as to facilitate easy installation, in certain embodiments, the size and/or shape of the plate S may vary depending on the model of chair to which the footrests will be attached. In certain embodiments, the size and/or shape of the holes (i.e., 11A and 11B) may vary.

Referring to FIG. 8B, a perspective view of one embodiment of the modified footrest of the present disclosure in a first position is shown. More particularly, a pair of footrest assemblies is shown attached to attachment plates 8. In certain embodiments of the present disclosure, the footrest assemblies further comprise a tube 15 attached to the underside of the attachment plate 8 and extending down from the bottom of the seat 4. In certain embodiments, the tube 15 is welded to the plate 8. In certain embodiments of the present disclosure, the tube 15 is attached to an upper leg support 12. In certain embodiments, the upper leg support 12 is configured from a single piece of material. In certain embodiments, the footrest assemblies further comprise a supplementary support member 13. In certain embodiments, the lower leg support 17 is configured from one or more straight portions and/or one or more curved portions to form a single lower leg support in certain embodiments, the tower leg support 17 is adapted to attach to the foot rest portion of the lower leg support 19. In certain embodiments of the present disclosure, the footrest portion 19 further comprises an end cap 21.

Referring to FIG. 8C, a front view of one embodiment of the modified footrest of the present disclosure in a first position is shown. More particularly, a pair of footrest assemblies is shown attached w attachment plates 8. In certain embodiments of the modified footrest of the present disclosure, the upper leg support 12 is attached to the tube 15 (not shown) using one or more mounting brackets 14. In certain embodiments, the footrest assemblies further comprise a supplementary support member 13 (not shown). In certain embodiments, the footrests further comprise an upper leg support 12 and a lower leg support 17. In certain embodiments, the lower leg support fluffier comprises a separate footrest portion 19. In certain embodiments, the lower leg support (e.g., 17 and 19) may be formed together, in certain embodiments, the upper and lower leg supports (e.g., 12 and 17) may be formed together.

Referring to FIG. 8D, a side view of one embodiment of the modified footrest of the present disclosure in a first position is shown. More particularly, a latch 20 is shown. In certain embodiments, the latch is a spring cam lock lever. In certain embodiments, the footrest assembly is angled at an angle A, away from the chair so as to provide a comfortable support for the user's feet when sitting in the salon chair. In certain embodiments, the upper leg support 12 is comprised of a single hollow metal tube that has been bent to produce the angle A. In certain embodiments, the upper leg support 12 is comprised of a single hollow metal tube that has been bent to produce the angle A and is configured to attach to the lower leg support 17. In certain embodiments of the modified footrest of the present disclosure, all or some of the footrest assembly may be chrome plated to provide for an aesthetically pleasing footrest capable of use in the most stylish of salons. In certain embodiments, there is a flat structural support, plate configured to connect tube 15 to the attachment plate 8. In certain embodiments of the present disclosure, the tube 15 further comprises an end cap 21.

Figures 9A, 9B:
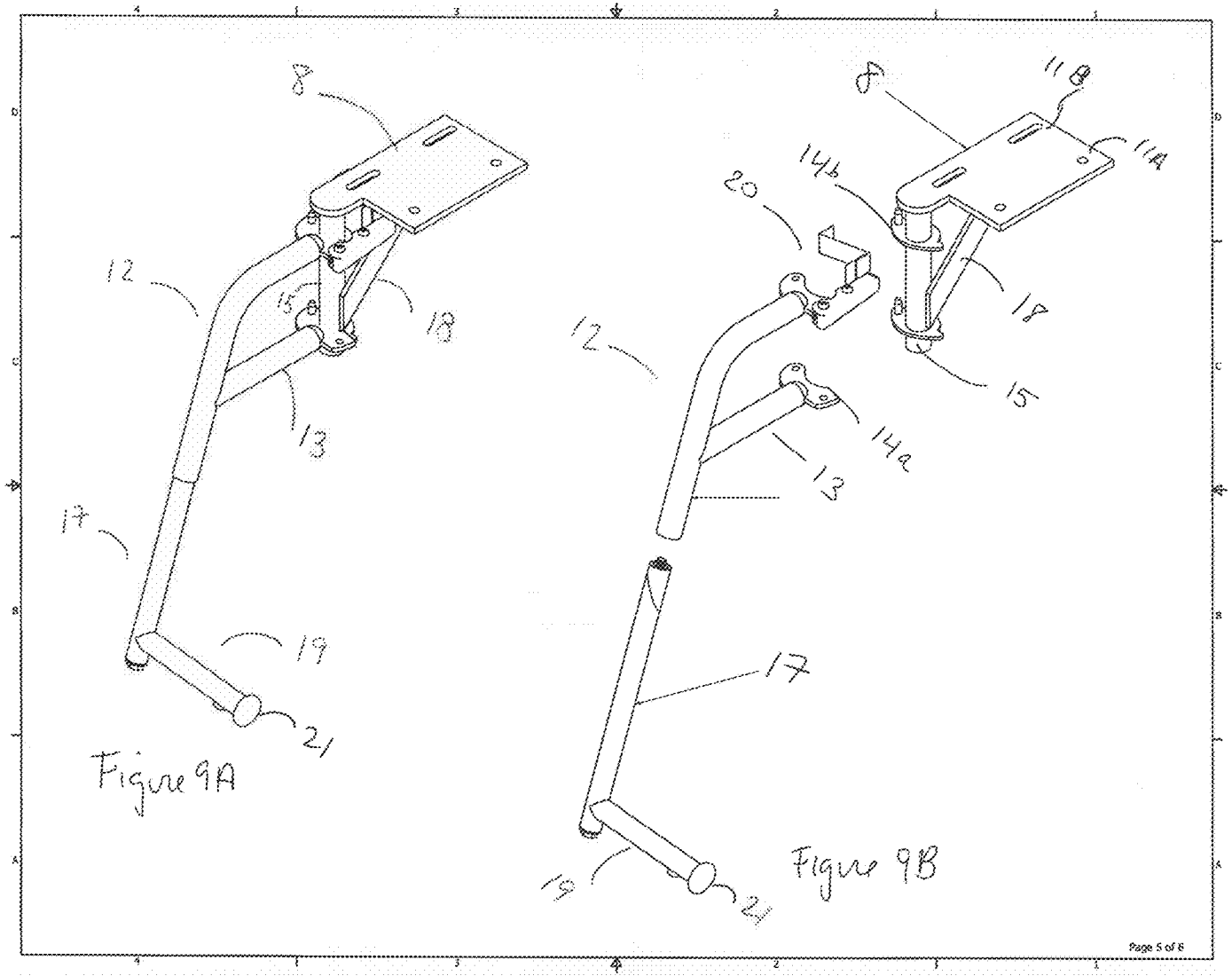
FIG. 9A shows a perspective view of one embodiment of one half of the modified footrest of the present disclosure.
FIG. 9B shows a perspective view of one embodiment of one half of the modified footrest of the present disclosure with the upper and the lower sections separated.

Referring to FIG. 9A, a perspective view of one embodiment of one half of the modified footrest of the present disclosure is shown. Referring to FIG. 9B, a perspective view of one embodiment of one half of the modified footrest of the present disclosure is shown with the upper and the lower portions of the footrest assembly separated and with the lower portion further separated into an upper leg support 12 and a lower leg support 17. More particularly, one embodiment of the upper section of the footrest assembly is shown with an attachment plate 8, a tube 15, and upper portion mounting brackets 14*b*. In one embodiment of the modified footrest assembly, the lower section is shown with a latch 20, lower portion mounting brackets 14*a*, a upper leg support 12, a supplementary support member 13. In certain embodiments, the footrest assembly further comprises an upper leg support 12, a lower leg support 17, and a footrest portion 19. In certain embodiments of the present disclosure, the footrest portion 19 further comprises an end cap 21. Still referring to FIG. 9B, in certain embodiment the brackets 14*a* and 14*b* are used to mount and unmount the footrest assemblies to the salon chair.

In certain embodiments, the modified footrest is transitioned from position 1 (closed) to position 2 (open) by releasing a latch 20. In certain embodiments, a user and/or stylist can push a latch near the underside of the styling chair, one on either side, to release the footrest from position 1. The release allows the footrest to move into position 2 by swinging on a hinge pin, one on either side of the salon chair. It is understood that a variety of latching mechanisms may be used for this purpose, but that the latch must provide ease of use for the stylist and/or user. In certain embodiments, the latch retains the footrest in position 1 until the user and/or stylist indicates a desire to move into the alternate position. In certain embodiments, once the user is in the chair, the footrests can be swung into position 1. In certain embodiments of the modified footrest of the present disclosure, the footrest "locks" into position automatically with a spring cam lock lever. In certain embodiments, additional components can be added to the upper or lower portion to create additional friction to better control the force need to move the footrest between positions. In certain embodiments, an additional component can include rubber.

Figure 10:
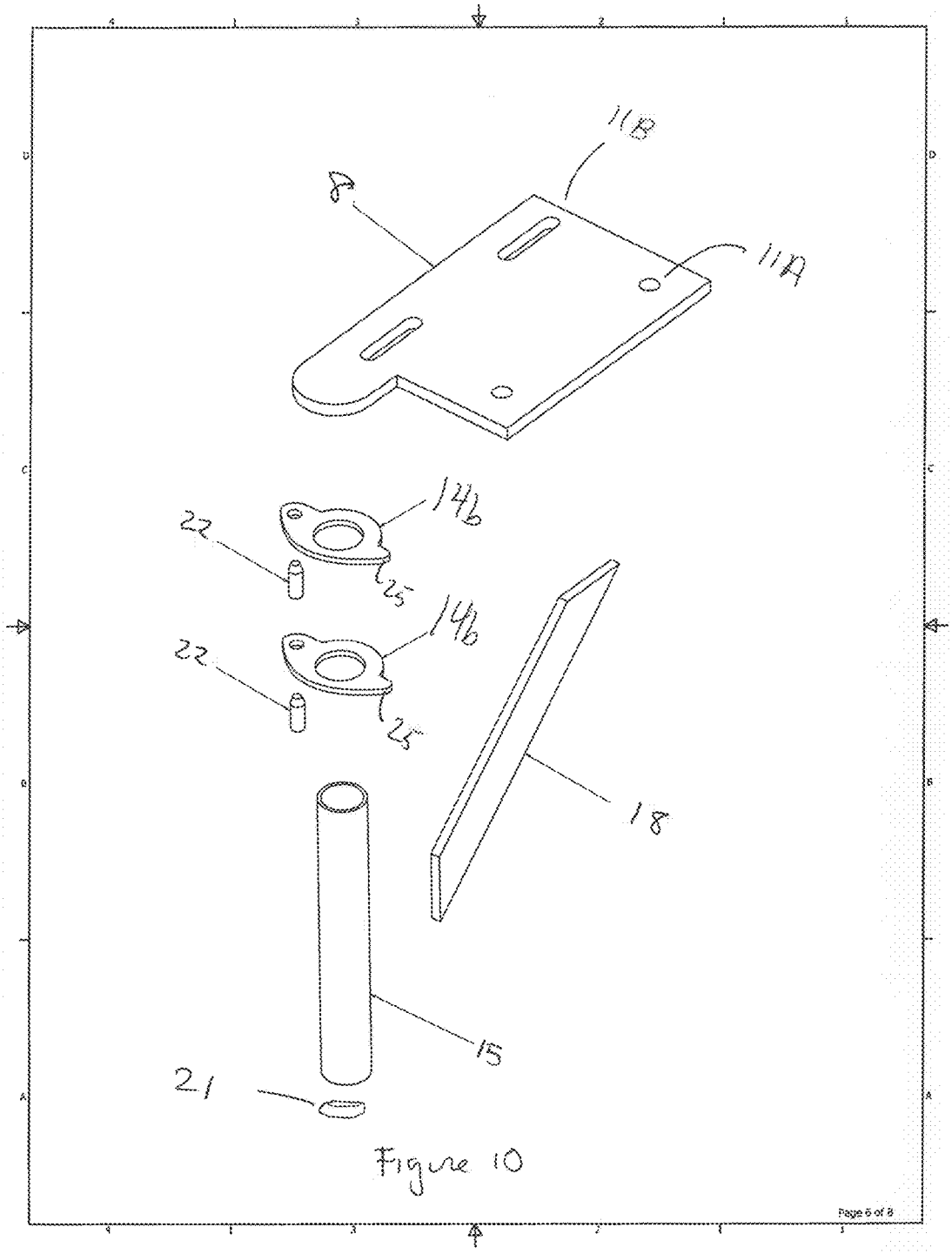
FIG. 10 shows an expanded view of the upper section of one half of one embodiment of the modified footrest of the present disclosure.

Referring to FIG. 10, an expanded view of the upper section of one half of one embodiment of the modified footrest of the present disclosure is shown. More particularly, an attachment plate 8 is shown with a plurality of attachment holes 11A and 11B. It is understood that a variety of shapes and sizes of attachment plates are possible and the choices depend on the intended chair that will utilize the modified footrest. Also shown in FIG. 10 is an embodiment of the modified footrest that contains a tube 15. In certain embodiments, the upper leg support further includes one or more structural support plates 18. In certain embodiments, the structural support plate is flat. In certain embodiments, the structural support plate is round. In certain embodiments, the tube 15 has an end cap 21.

Still referring to FIG. 10, in certain embodiments the modified footrest of the present disclosure comprises one or more hinge pins 22. In certain embodiments, the modified footrest of the present disclosure comprises one or more mounting brackets (e.g., 14*a*, 14*b* as seen in FIG. 9B) used to attach the upper leg support 12 and/or the supplementary support 13 to the tube 15. In certain embodiments, the brackets may include a protrusion 25 for use with the latching assembly.

Figure 11A:
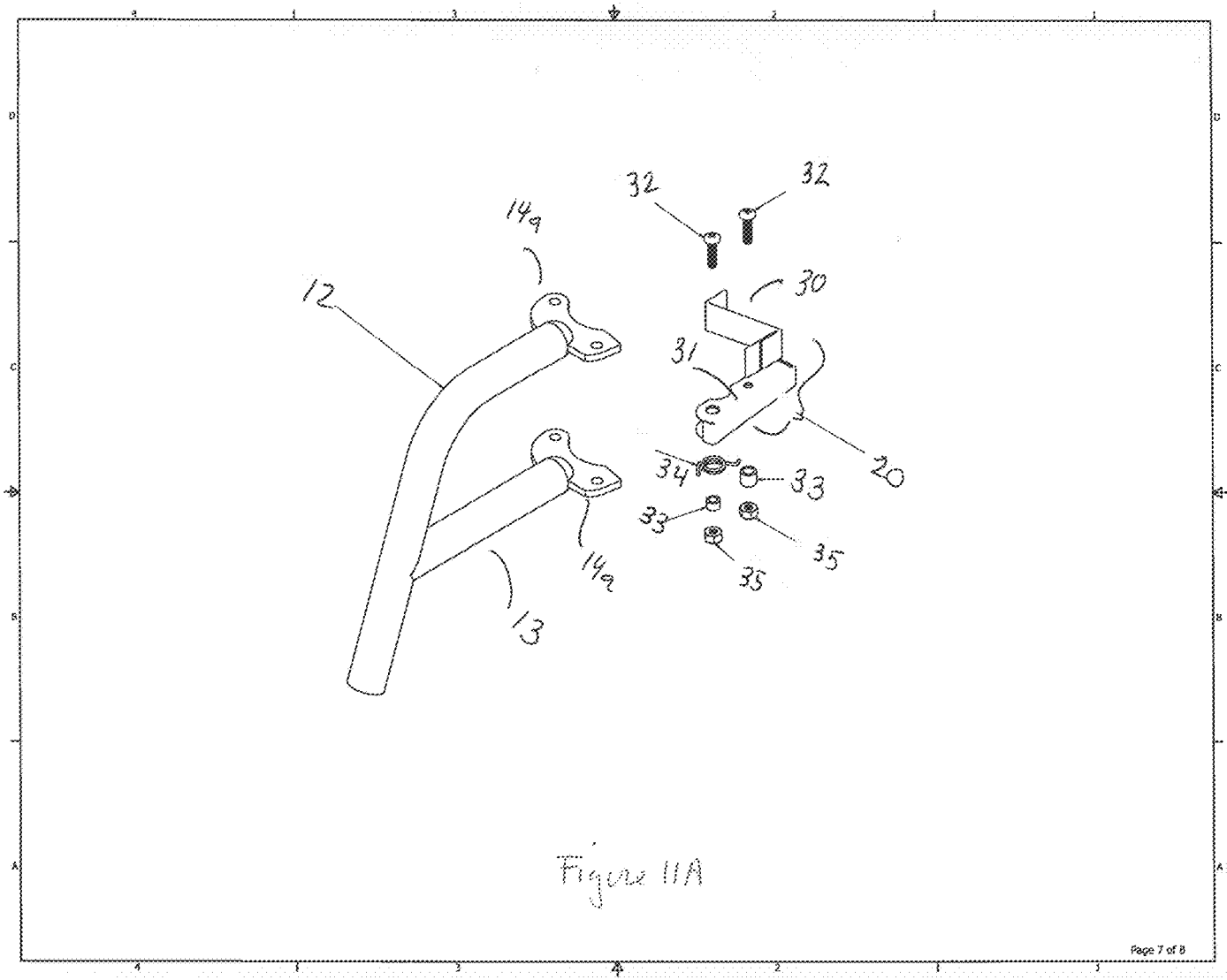
FIG. 11A shows an expanded view of the upper part of the lower section of one half of one embodiment of the modified footrest of the present disclosure as shown in FIG. 9B.

Referring to FIG. 11A, an expanded view of the upper leg support of one half of one embodiment of the modified footrest of the present disclosure is shown. More particularly, in certain embodiments an upper leg, support 12 and a supplementary support 13 are connected to mounting brackets 14*a*. In certain embodiments, one or more mounting brackets are attached to a latch 20. In certain embodiments, the latching mechanism further comprises one or more of the following a spring 34, screws 32, bolts 35 and bushings 33.

Figure 11B:
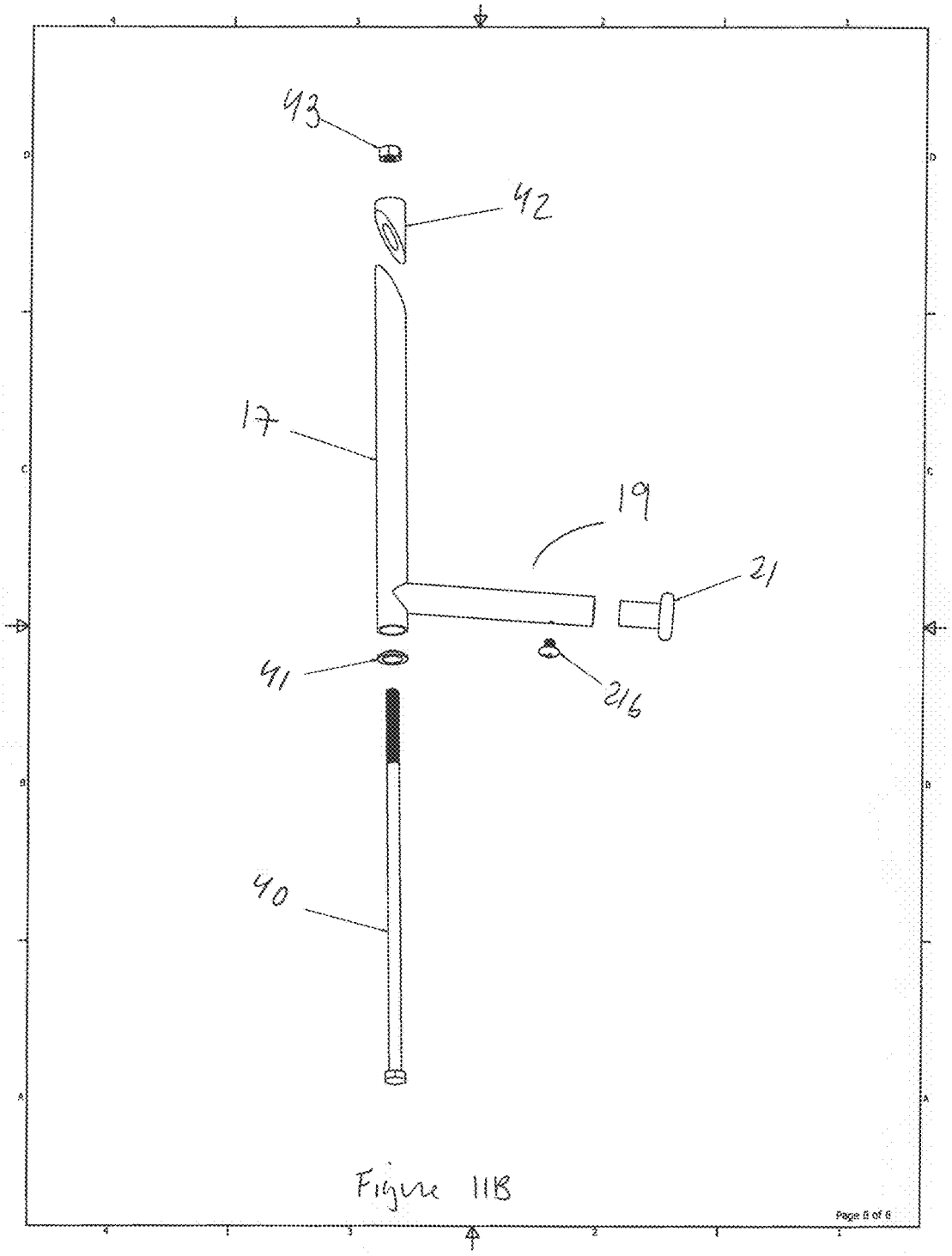
FIG. 11B shows an expanded view of the lower part of the lower section of one half of one embodiment of the modified footrest of the present disclosure as shown in FIG. 9B.

Referring to FIG. 11B, an expanded view of the lower leg support 17 of one half of one embodiment of the modified footrest of the present disclosure is shown. More particularly, in certain embodiments the lower leg support 17 further comprises a footrest portion 19. In certain embodiments, the footrest portion further comprises an end cap 21. In certain embodiments, the lower leg support is comprised of two main components. The first is the "L" shaped footrest and end cap (e.g., 17, 19, and 21). The "L" may consist of the lower leg support 17, the footrest 19, which is the section where a user will rest their feet, and an end cap 21. In certain embodiments, the end cap is attached via a set screw 21*b*. In certain embodiments, the end cap may be comprised of rubber or like materials. The second component of the lower leg support is the mechanism which holds the lower leg support 17 to the swivel assemblies (e.g., 12 and 13). In certain embodiments, the mechanism comprises a hex shoulder screw 40, a cupped washer 41, a wedge lock 42, and a nut 43. In certain embodiments, the shoulder screw passes through the cupped washer, through the vertical pipe 17 of the first main component, through the wedge lock, and is secured with the nut. By tightening the shoulder screw, the nut pulls the wedge lock and vertical pipe together, securing the footrest on the swivel mount (e.g. 12).

Figure 12:
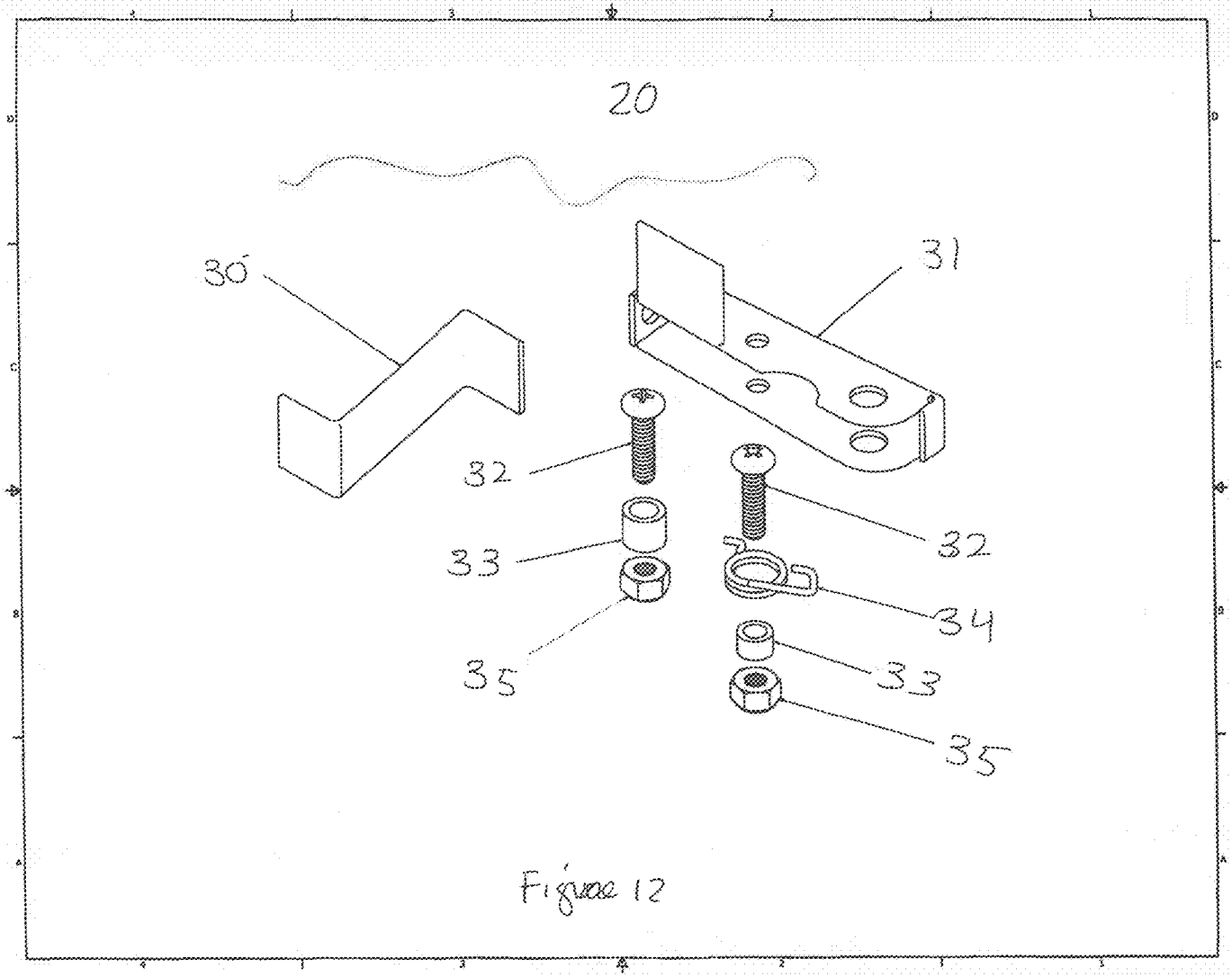
FIG. 12 shows an expanded view of one embodiment of a latch for the modified footrest of the present disclosure.

Referring to FIG. 12, an expanded view of one embodiment of a latch for the modified footrest of the present disclosure is shown. More particularly, one embodiment of a latch 20 is shown with a spring 34, screws 32, bolts 35, and bushings 33. In certain embodiments of the latch of the modified footrest, a lever arm 30 and a housing 31 are present. In certain embodiments, the housing 31 is attached to a mounting bracket used to join the lower portion to the upper portion of the footrest assembly.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A modified footrest assembly for a salon chair comprising, an upper portion, comprising an attachment plate to removably attach the footrest assembly to a salon chair, wherein the salon chair has a front, a back, a first side, and second side wherein the first side and the second side define a width of the salon chair;

a tube;

one or more upper mounting brackets attached to the tube; and one or more hinge pins accompanying the upper mounting brackets; and a lower portion, comprising a first leg support having a length wherein the first leg support is configured to support a person's first foot on a first foot rest in a first use position in front of the salon chair and wherein the first leg support is configured to not protrude beyond the first side of the salon chair when in a second non-use position, wherein the second non-use position is where the first foot rest is underneath the first side of the salon chair;

a second leg support having a length wherein the second leg support is configured to support a person's second foot on a second foot rest in the first use position and wherein the second leg support is configured to not protrude beyond the second side of the salon chair when in the second non-use position, wherein the second non-use position is where the second foot rest is underneath the second side of the salon chair;

one or more lower mounting brackets attached to the first and the second leg supports; and a latch attached to each of the one or more lower mounting brackets, thereby forming a modified footrest for the salon chair that is configured to pivot on the one or more hinge pins of the upper portion between the first use position and the second non-use position, wherein the each of the latches further comprises a spring configured to influence the motion of the lower portion of the footrest relative to the upper portion of the footrest assembly such that the modified footrest assembly automatically locks into the first use position via a spring cam lock lever.

2. The modified footrest assembly for a salon chair of claim 1, wherein each of the first and the second leg supports has a round cross section.

3. The modified footrest assembly for a salon chair of claim 1, wherein each of the first and the second leg supports is hollow.

4. The modified footrest assembly for a salon chair of claim 1, wherein each of the first and the second leg supports is chrome plated.

5. The modified footrest assembly for a salon chair of claim 1, wherein the lower portion of the footrest assembly comprises a first and a second upper leg support and a first and a second lower leg support.

6. A salon chair comprising, a backrest;

a seat having a width defined by the distance between a first and a second side, a front, a back, a depth, a top surface and a bottom surface;

a pedestal attached at the center of the bottom surface of the seat such that the seat of the salon chair rotatable about an axis coincident with the pedestal, the pedestal having a base;

a footrest assembly comprising;

an upper portion, comprising an attachment plate to removably attach the footrest assembly to the salon chair;

a tube;

one or more upper mounting brackets attached to the tube; and one or more hinge pins accompanying each of the upper mounting brackets; and a lower portion, comprising a first leg support having a length wherein the first leg support is configured to support a person's first foot on a first footrest in a first use position in front of the salon chair and wherein the first leg support is configured to not protrude beyond the first side of the salon chair when in a second non-use position, wherein the second non-use position is where the first footrest is underneath the first side of the salon chair;

a second leg support having a length wherein the second leg support is configured to support a person's second foot on a second footrest in the first use position and wherein the second leg support is configured to not protrude beyond the second side of the salon chair when in the second non-use position, wherein the second non-use position is where the second footrest is underneath the second side of the salon chair;

one or more lower mounting brackets attached to the first and the second leg supports; and a latch attached to each of the one or more lower mounting brackets, thereby forming a modified footrest for the salon chair that is configured to pivot from the first use position to the second non-use position about the one or more hinge pins, wherein each of the latches further comprises a spring configured to influence the motion of the lower portion of the footrest relative to the upper portion of the footrest assembly such that the modified footrest assembly automatically locks into the first use position via a spring cam lock lever.

7. The salon chair of claim 6, wherein each of the first and the second leg supports has a round cross section.

8. The salon chair of claim 6, wherein each of the first and the second leg supports is hollow.

9. The salon chair of claim 6, wherein each of the first and the second leg supports is chrome plated.

10. The salon chair of claim 6, wherein the lower portion of the footrest assembly comprises a first and a second upper leg support and a first and a second lower leg support.

11. A lower portion of a footrest assembly for a salon chair, comprising removable attachment to an upper portion of the footrest assembly, the upper portion comprising an attachment plate, wherein the salon chair has a front, a back, a first side, and a second side, wherein the first side and the second side define a width of the chair;

a first leg support having a length wherein the first leg support is configured to support a person's first foot on a first footrest in a first use position in front of the salon chair and wherein the first leg support is configured to not protrude beyond a first side of the salon chair when in a second non-use position, wherein the second non-use position is where the first footrest is underneath the first side of the salon chair;

a second leg support having a length wherein the second leg support is configured to support a person's second foot on a second footrest in the first use position and wherein the second leg support is configured to not protrude beyond the second side of the salon chair when in the second non-use position, wherein the second non-use position is where the second footrest is underneath the second side of the salon chair;

one or more lower mounting brackets attached to the first and the second leg supports; and a latch attached to each of the one or more lower mounting brackets, thereby forming a modified footrest for the salon chair that is configured to pivot from a first use position to a second non-use position about one or more hinge pins, wherein each of the latches further comprises a spring configured to influence the motion of the lower portion of the footrest relative to the upper portion of the footrest assembly such that the modified footrest assembly automatically locks into the first use position via a spring cam lock lever.

12. The lower portion of a footrest assembly of claim 11, wherein each of the first the second leg supports has a round cross section.

13. The lower portion of a footrest assembly of claim 11, wherein each of the first and the second leg supports is hollow.

14. The lower portion of a footrest assembly of claim 11, wherein each of the first and the second leg supports is chrome plated.

15. The lower portion of a footrest assembly of claim 11, further comprising a first and a second upper leg support and a first and a second lower leg support.

* * * * *